US007004752B2

(12) United States Patent
Weathersbee

(10) Patent No.: US 7,004,752 B2
(45) Date of Patent: Feb. 28, 2006

(54) METHOD OF FORMING A CANDLE WITH MULTIPLE PEELABLE COLOR LAYERS

(75) Inventor: Nicolas A. Weathersbee, St. Petersburg, FL (US)

(73) Assignee: Global Candle Gallery Licensing Co., Apollo Beach, FL (US)

( * ) Notice: Subject to any disclaimer, the term of this patent is extended or adjusted under 35 U.S.C. 154(b) by 143 days.

(21) Appl. No.: 10/840,000

(22) Filed: May 5, 2004

(65) Prior Publication Data

US 2005/0250063 A1 Nov. 10, 2005

(51) Int. Cl.
*F23D 3/16* (2006.01)

(52) U.S. Cl. ..... 431/288; 431/289

(58) Field of Classification Search ..... 431/288, 431/289, 297, 325, 126; 427/442, 443
See application file for complete search history.

(56) References Cited

U.S. PATENT DOCUMENTS 1,596,017 A * 8/1926 Harnisch ..... 427/264
1,825,785 A * 10/1931 Finn ..... 427/443
2,817,225 A 12/1957 Weglin
2,841,972 A * 7/1958 Weglin ..... 427/273
3,000,753 A * 9/1961 Rockland ..... 431/288
4,096,299 A 6/1978 Stewart
5,019,424 A 5/1991 Strelnieks
5,597,300 A 1/1997 Wohl et al.
6,079,975 A 6/2000 Conover
6,450,802 B1 9/2002 Steck

* cited by examiner

*Primary Examiner*—Alfred Basichas
(74) *Attorney, Agent, or Firm*—Larson & Larson, PA; Herbert W. Larson

(57) ABSTRACT

A wax core is dipped multiple times in liquid clear wax and water sequentially. Thereafter, the candle is dipped multiple times in a liquid pigmented wax to form a first pigmented layer. When the desired shade is achieved, one or more layers of clear wax is added. The cooled pigmented wax layer with a clear layer on top is then dipped in water multiple times to produce a primed surface layer at ±1 degree ambient. The candle is now rubbed to assist the peeling of any layer over the primed surface. Multiple layers of clear wax are then added followed by a second pigmented wax. The process is repeated for as many pigmented wax layers as desired. The final candle has a glaze outer layer applied by dipping.

7 Claims, 22 Drawing Sheets

METHOD OF FORMING A CANDLE WITH MULTIPLE PEELABLE COLOR LAYERS

BACKGROUND OF THE INVENTION

This invention relates to methods of manufacturing candles. More particularly, it refers to a method of manufacturing peelable multi-layer candles of mixed colors.

Paraffin waxes have been used to make candles for hundreds of years. Early candles were made by dipping a wick in molten paraffin ladled into molds. Upon cooling, the candle was ready for use. Additives were added to molten paraffin to color the wax, but many of the early additives interfered with the burning of the candle or caused toxic fumes, contaminating the air in which the candles burned. Subsequently, pigments of either mineral or organic origin were developed which did not interfere with candle burning or contaminate the air around the burning candle. With such discovery, it was not long before candle makers started decorating candles such as shown in U.S. Pat. Nos. 2,817,225; 2,841,972; 4,096,299; and 6,450,802. Many different colors in a single candle provide more decorative patterns and is highly desirable. Dipping candles into a clear wax, then directly into colored wax, and blowing on the surface of the candle as it comes out of the colored wax has been the traditional way of making decorative patterns on candles. However, this procedure causes the wax to blend and separate giving a marble like effect. This procedure contaminates one color with another, losing the original color in time and the color becomes bland. Current techniques cannot produce candles that are free from the bleeding of one color layer into another. In addition, attempts have been made in the prior art to add pigmented waxes of one color over a pigmented wax of another color. However, this has previously proved unsatisfactory in that the outer pigmented layer sticks to the lower pigmented layer and therefore, cannot be cleanly peeled off. A solution to these problems is needed.

SUMMARY OF THE INVENTION

The present invention solves the problem of making candles of varying color layers with easily peelable layers of one color peeled from underlying layers of another color. The steps of this invention start with a traditional wax ball core containing a cotton wick. This core is dipped into liquid clear wax three to thirty times. The candle is cooled in water after each dipping. A first color layer is formed by dipping the candle two to ten times in a liquid pigmented wax.

When the pigment color has been achieved, one layer of clear wax is added by dipping in liquid clear wax. After cooling the outer surface of the candle in water, the candle is rubbed. The candle is cooled to ±1 degree from ambient before rubbing.

About three to thirty layers of clear wax are added by dipping three to thirty times in a liquid clear wax and then the process is repeated with a second pigmented wax. Additional pigmented layers are added in the same way. The final layer of pigmented wax is covered with one or more layers of clear wax and a glaze.

BRIEF DESCRIPTION OF THE DRAWINGS

The invention is best understood by those having ordinary skill in the candle making art by reference to the following detailed description when considered in conjunction with the accompanying drawings in which.

DETAILED DESCRIPTION

Figure 1:
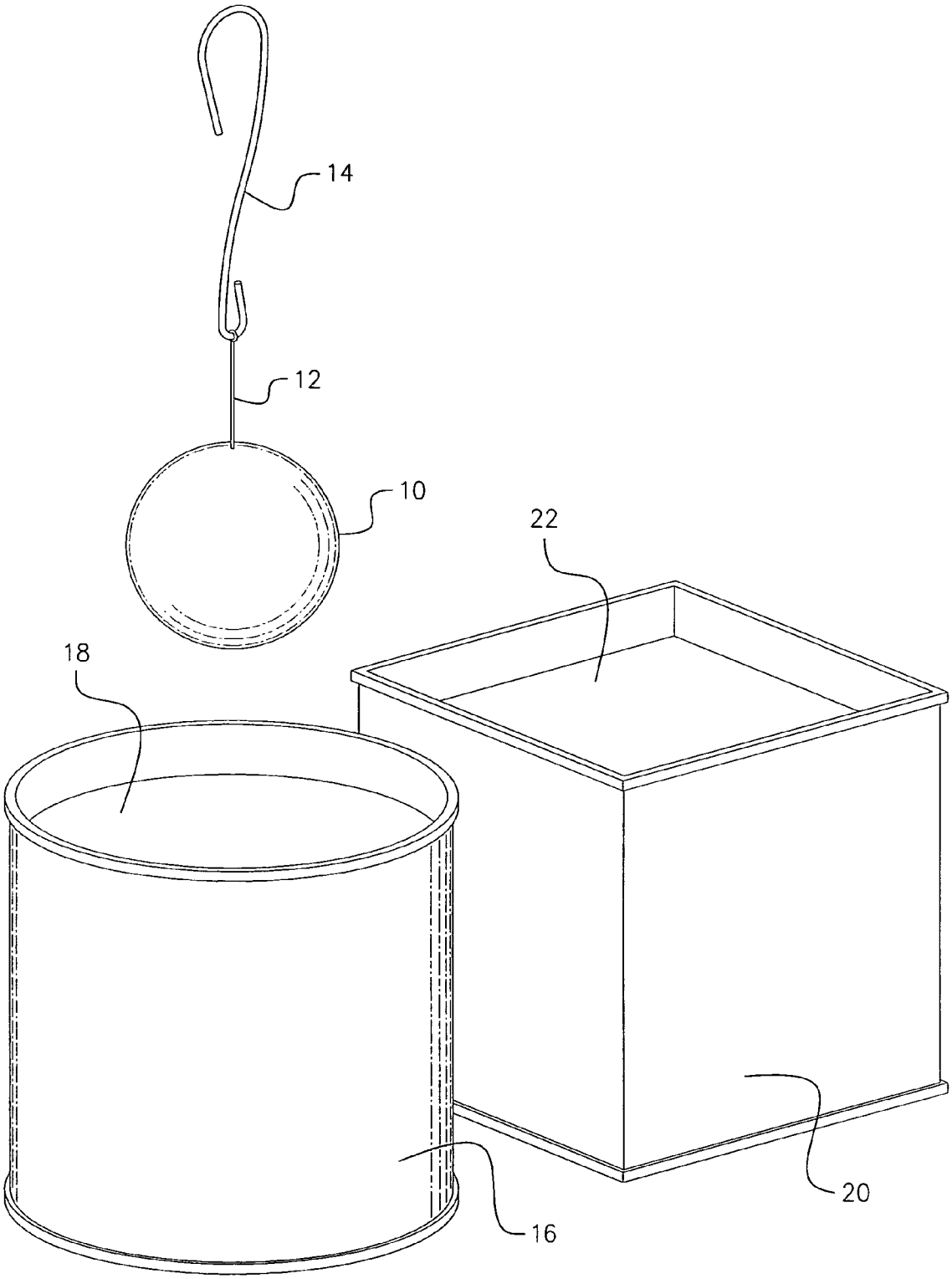
FIG. 1 shows wax core with wick tied to a hanger.

Throughout the following detailed description, the same reference numerals refer to the same elements in all figures.

Figure 2:
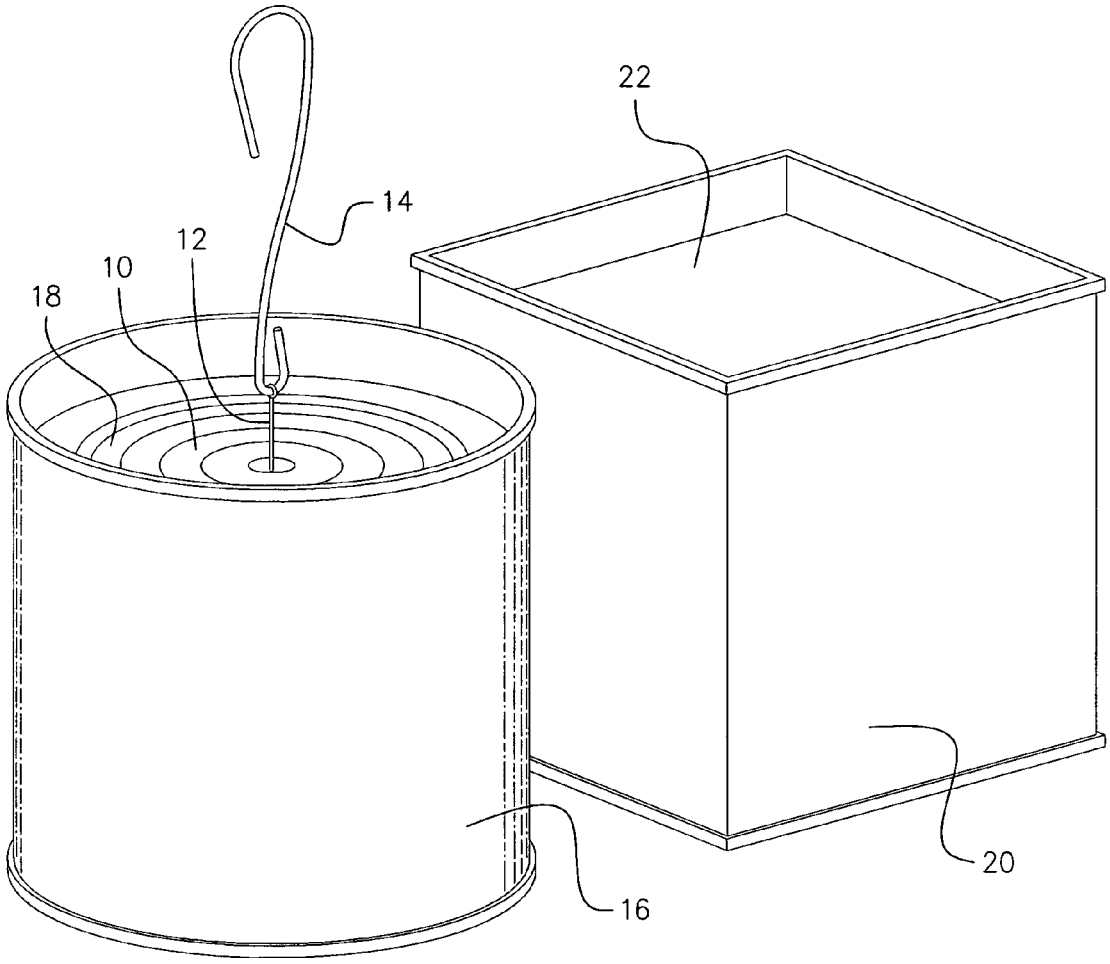
FIG. 2 shows core being dipped into liquid clear wax.
Figure 3:
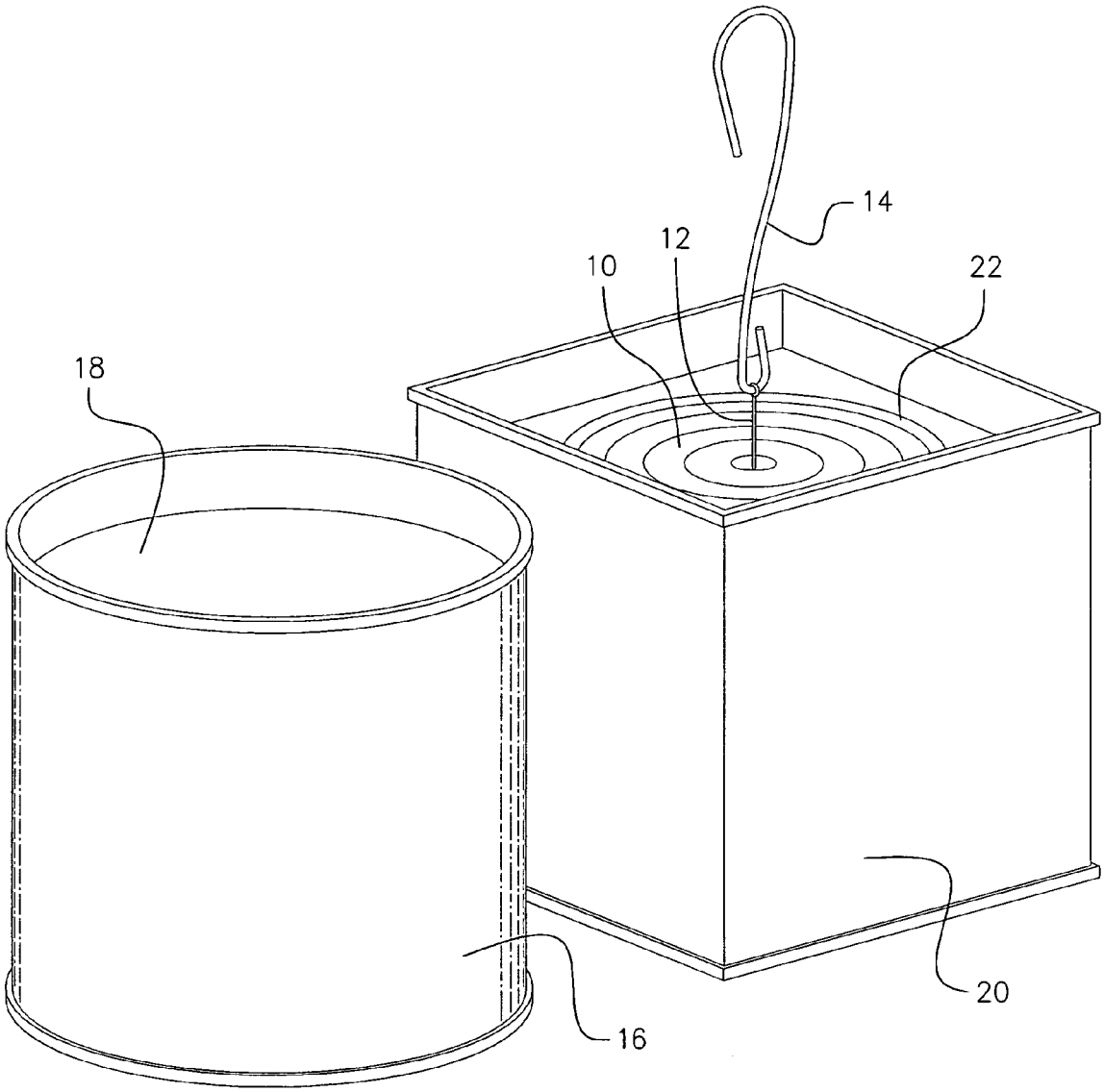
FIG. 3 shows core with exterior clear wax layer being dipped into water.
Figure 4:
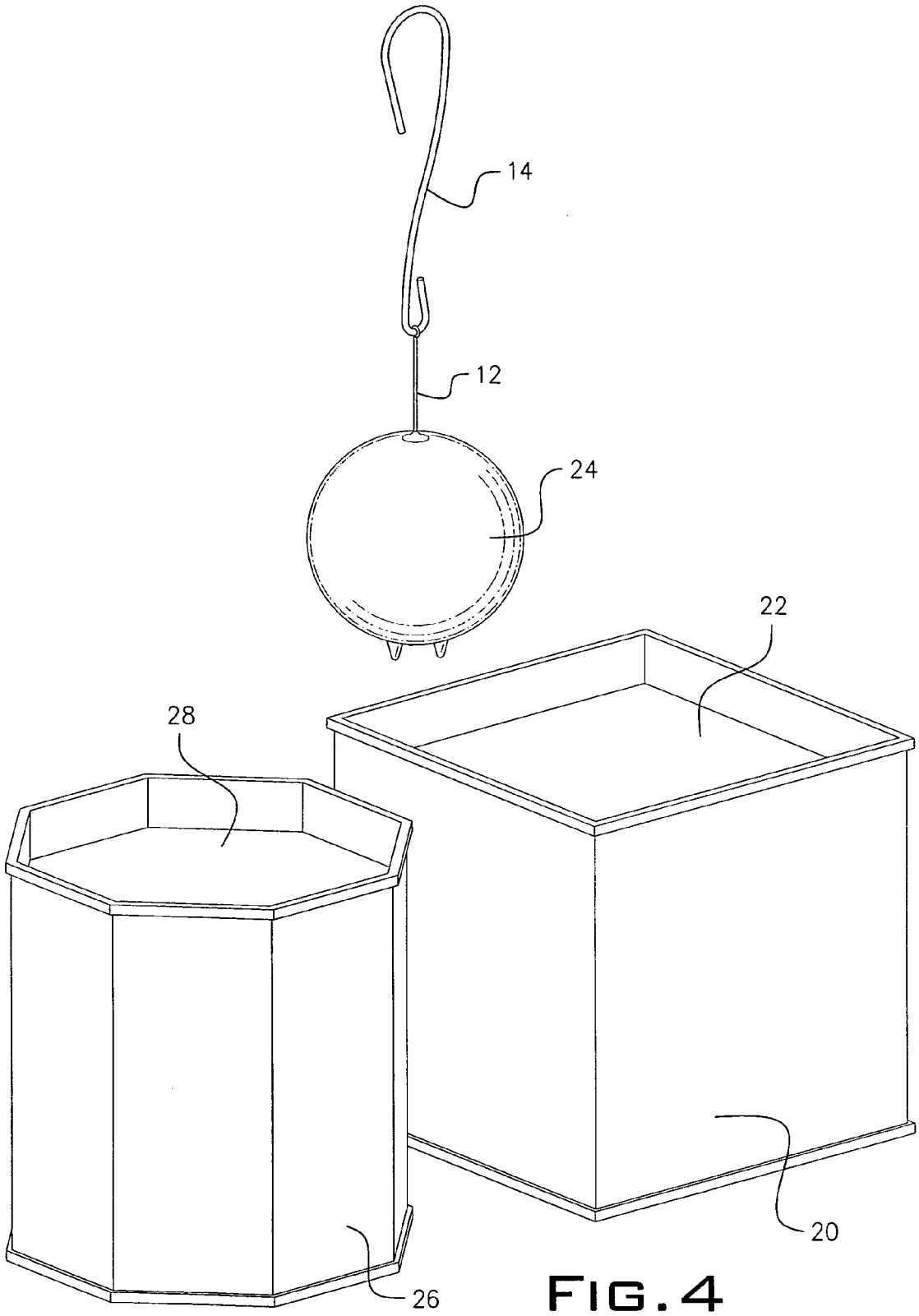
FIG. 4 shows candle about to be dipped into a liquid pigmented wax.
Figure 5:
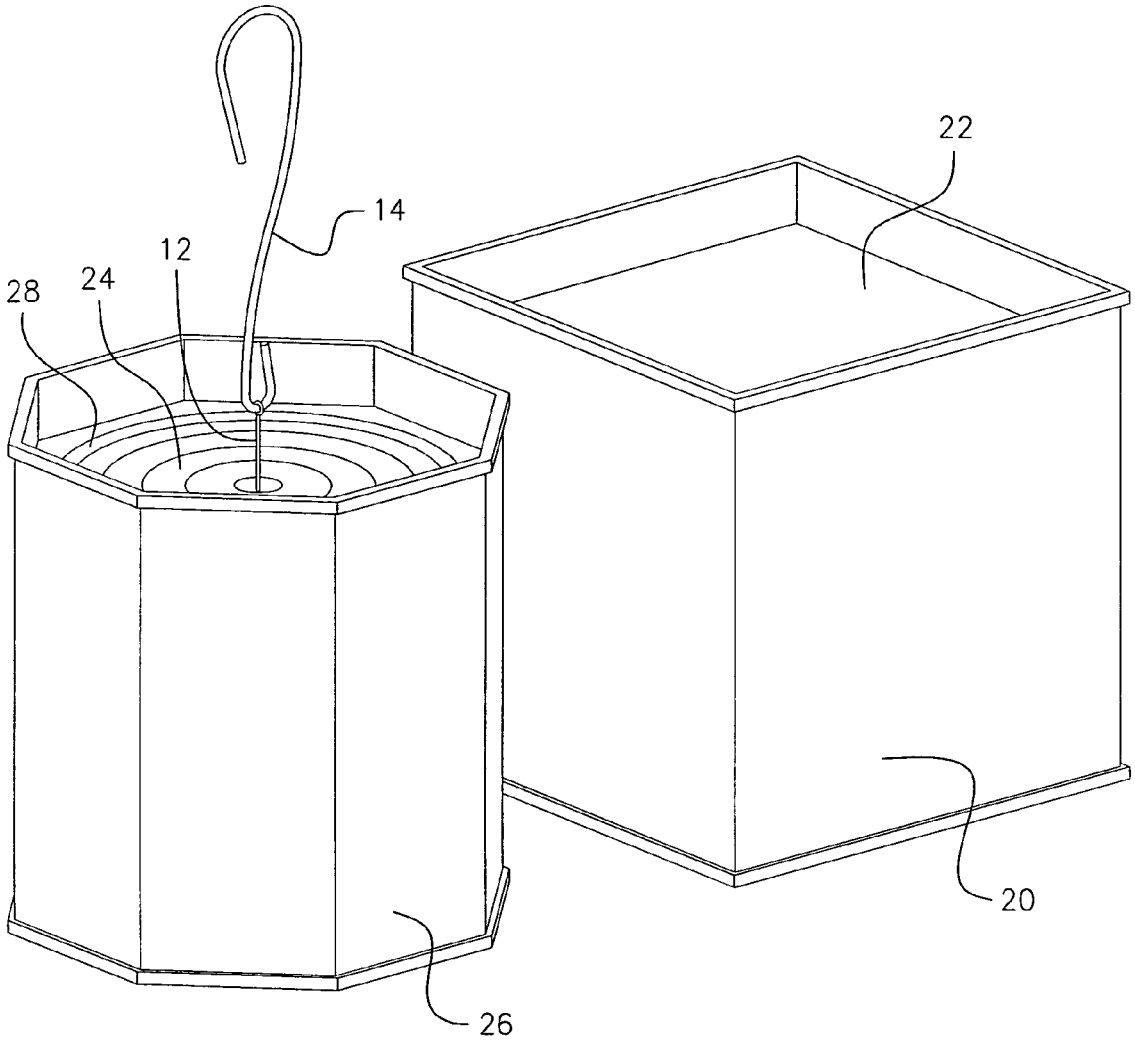
FIG. 5 shows candle dipped into liquid pigmented wax.
Figure 6:
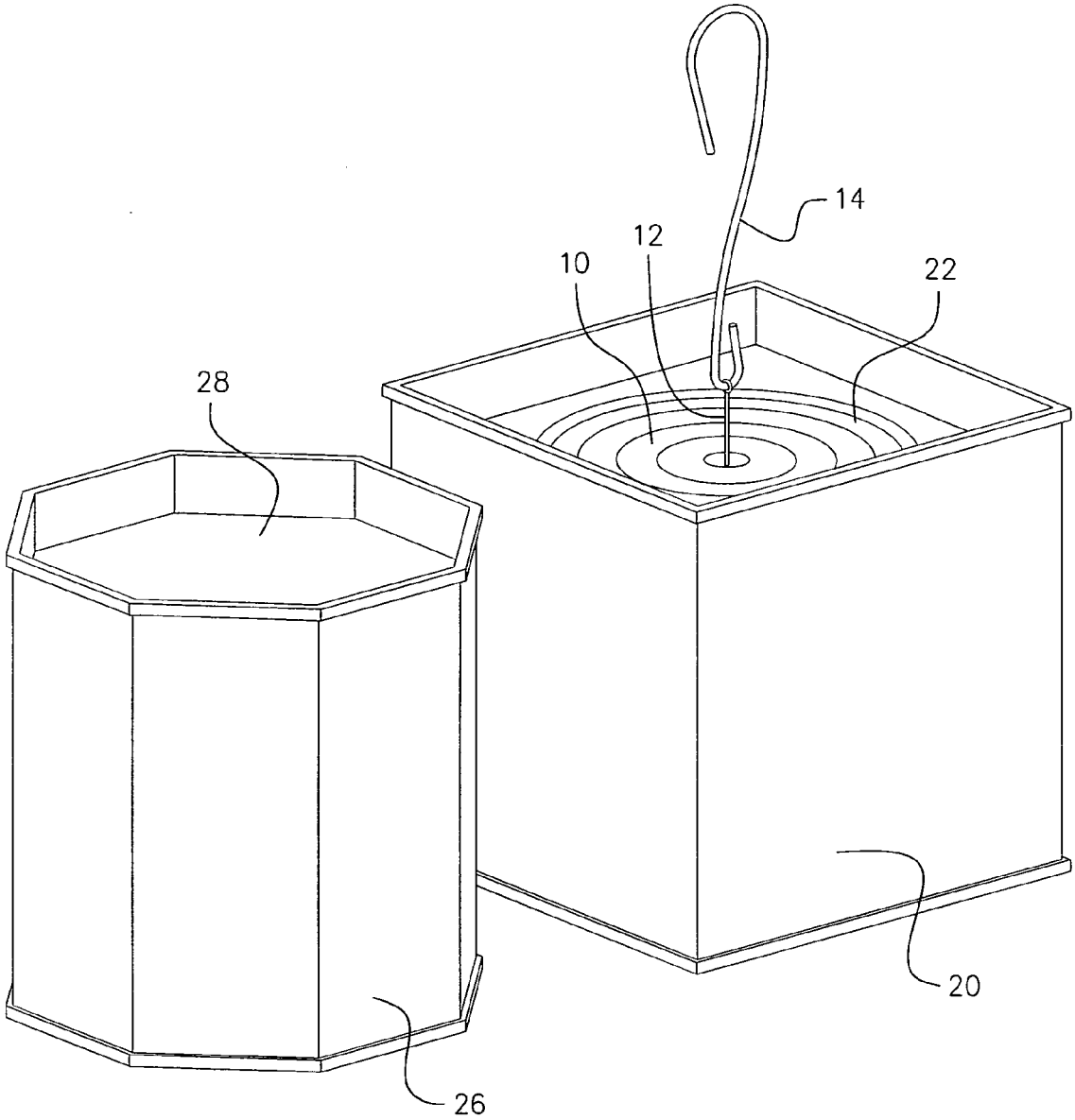
FIG. 6 shows candle being dipped into water.
Figure 7:
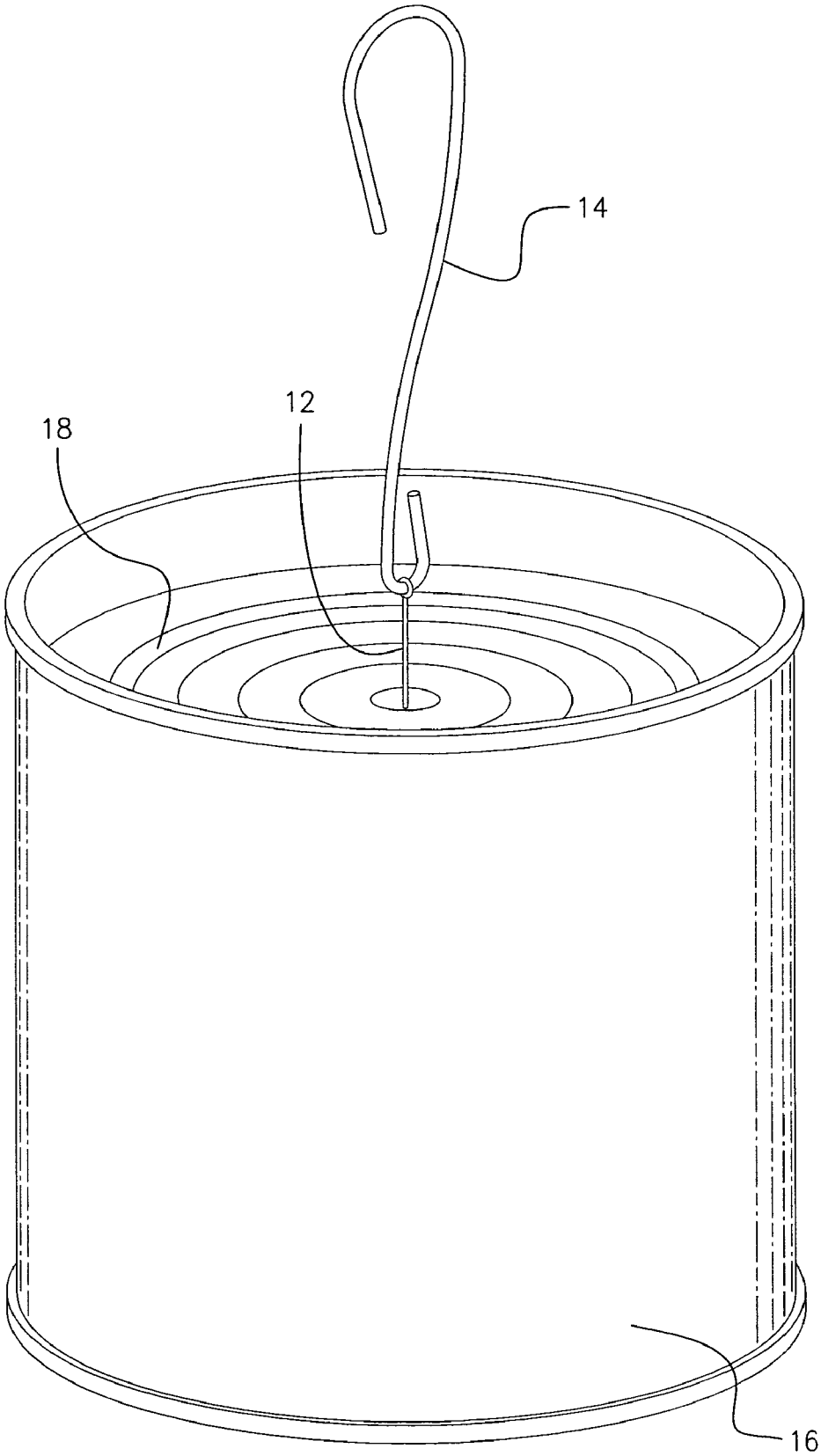
FIG. 7 shows candle dipped into liquid clear wax.
Figure 8:
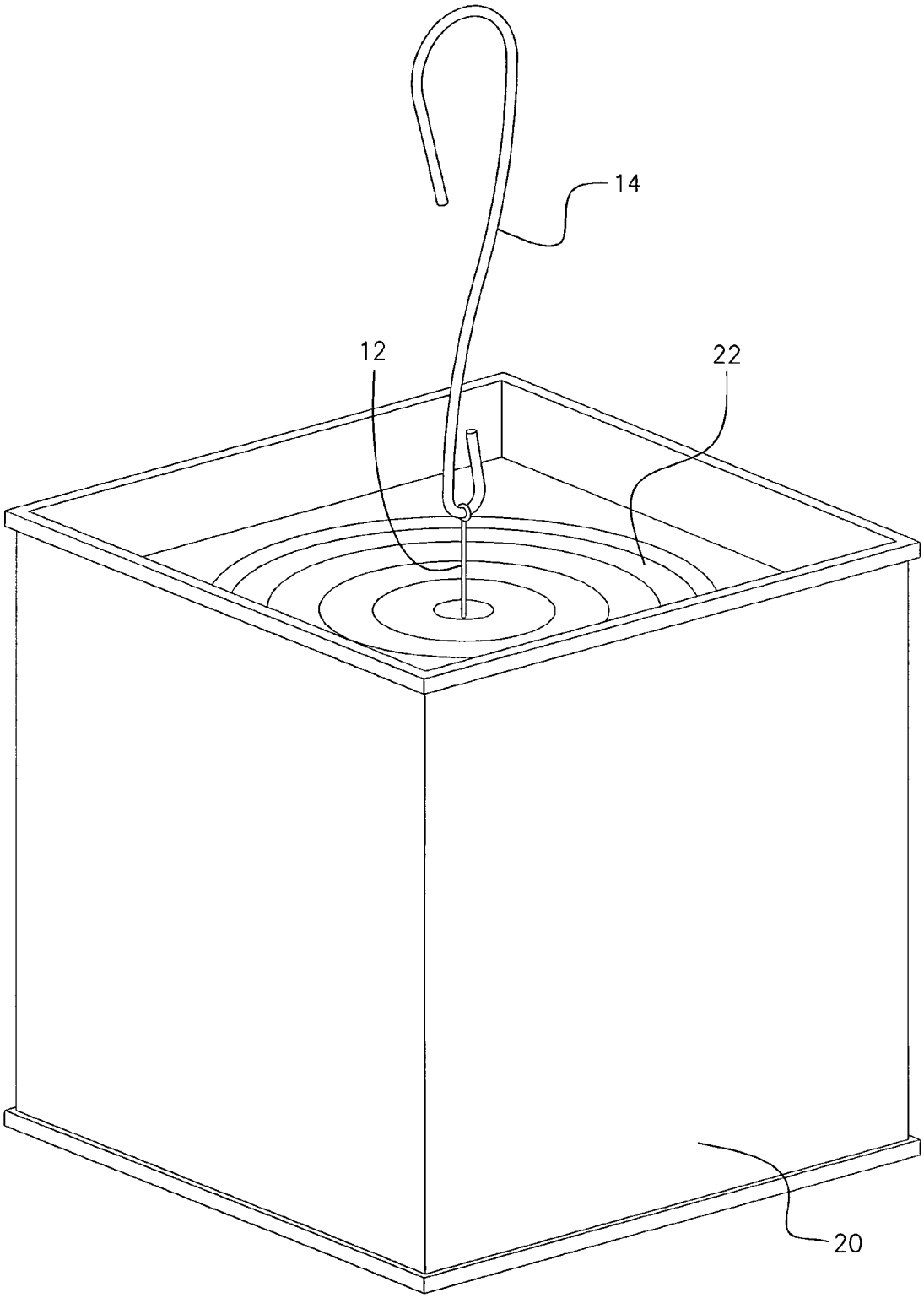
FIG. 8 shows candle dipped into water.

Referring to FIGS. 1–3, a core wax ball 10 has a wick 12 through approximately the wax ball's centerline. The wick is tied to a hanger 14 for further processing. First, the wax ball 10 is dipped into a container 16 containing a liquid clear wax 18 at a temperature of about 125 to 195 degrees F., and thereafter in a tub 20 containing water 22. The steps of FIGS. 2 and 3 are sequentially repeated multiple times. About ten dips in clear wax and water is usually sufficient to form an exterior clear wax layer 24 seen in FIG. 4. The clear wax layer 24 is then dipped in a tub 26 containing a liquid pigmented wax 28 at a temperature of about 125 to 195 degrees F., as seen in FIG. 5 and thereafter in tub 20 containing water 22. The steps of FIGS. 5 and 6 are repeated one or more times until a desired pigment shade is achieved. When the desired pigment shade is obtained the colored candle 30 is dipped again one or more times into liquid clear wax 18 and water 22 as seen in FIGS. 7 and 8 until a candle temperature of about ±1 degree F. ambient is obtained.

The preferred pigment color is Caribbean Blue and Christmas Red. However, many other pigments can be employed.

Figure 9:
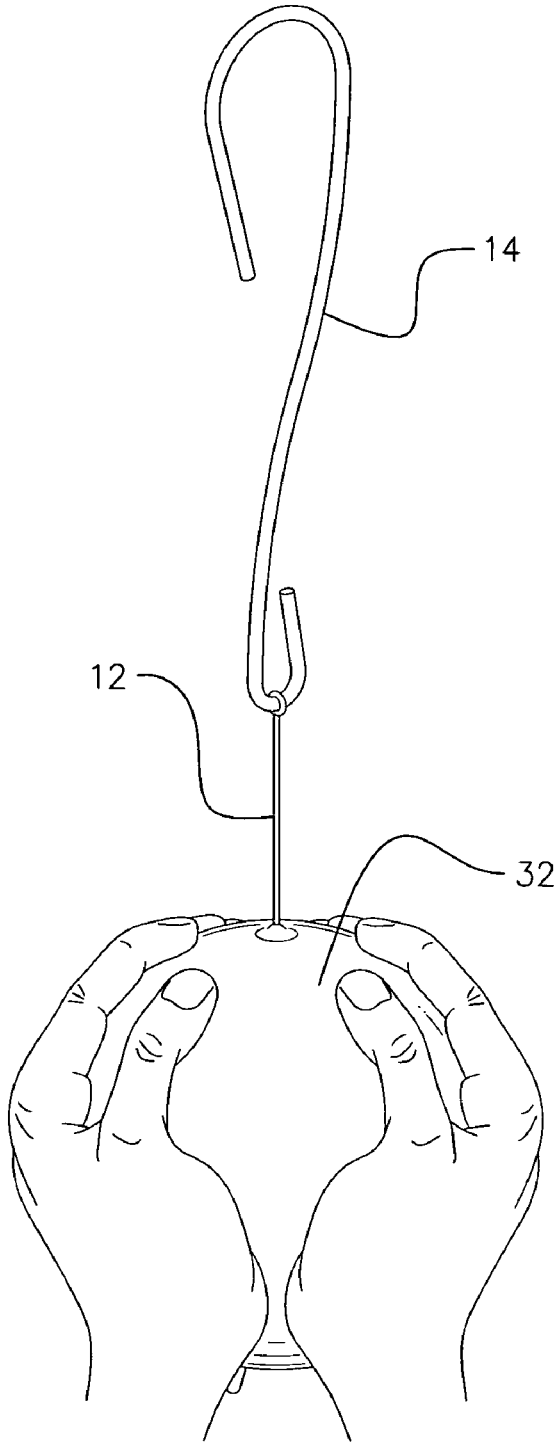
FIG. 9 shows candle being rubbed.

The candle is then rubbed by hand to smooth the surface and create a primed layer 32 for peeling as seen in FIG. 9. This assists in the peeling of the subsequent layers at the primed layer 32.

Figure 10:
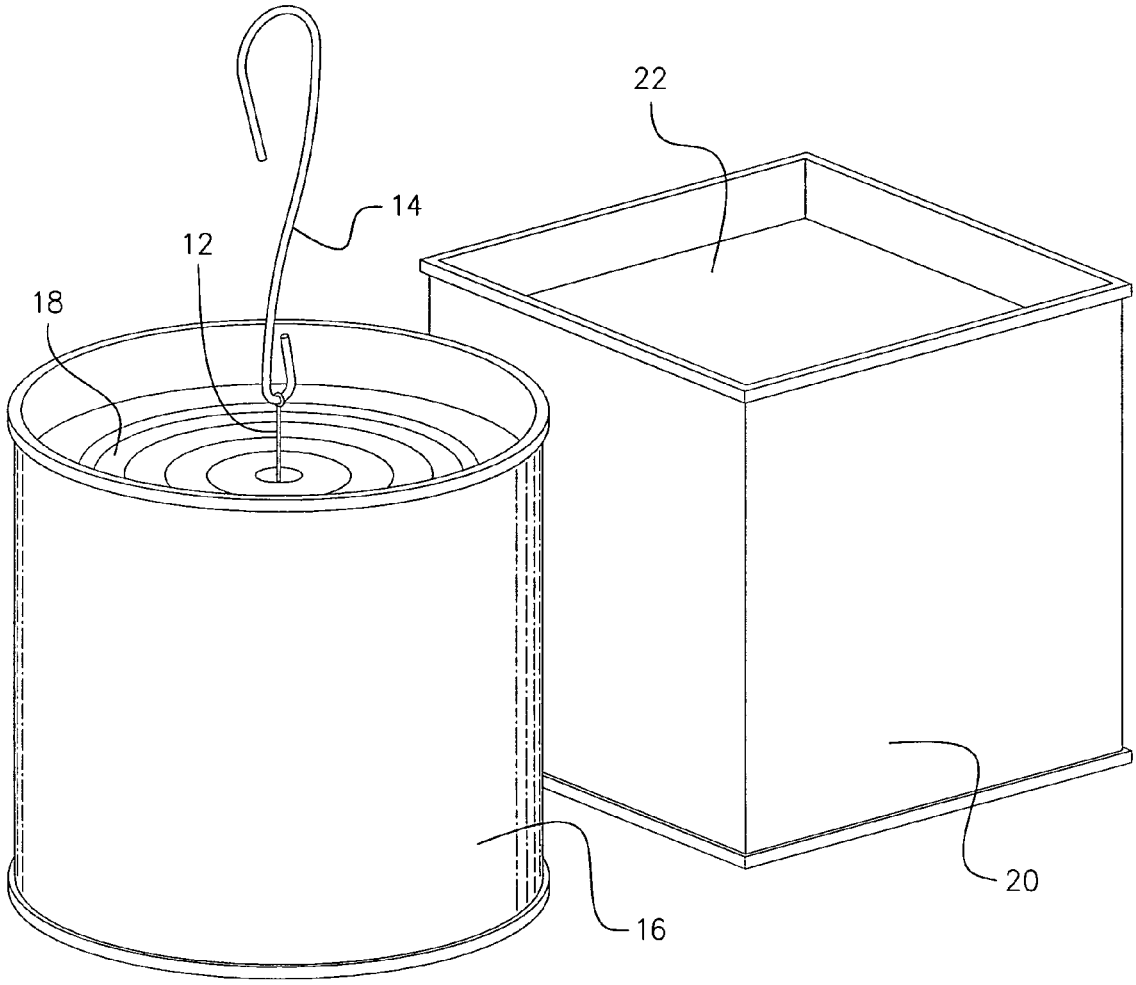
FIG. 10 shows rubbed candle dipped into liquid clear wax.
Figure 11:
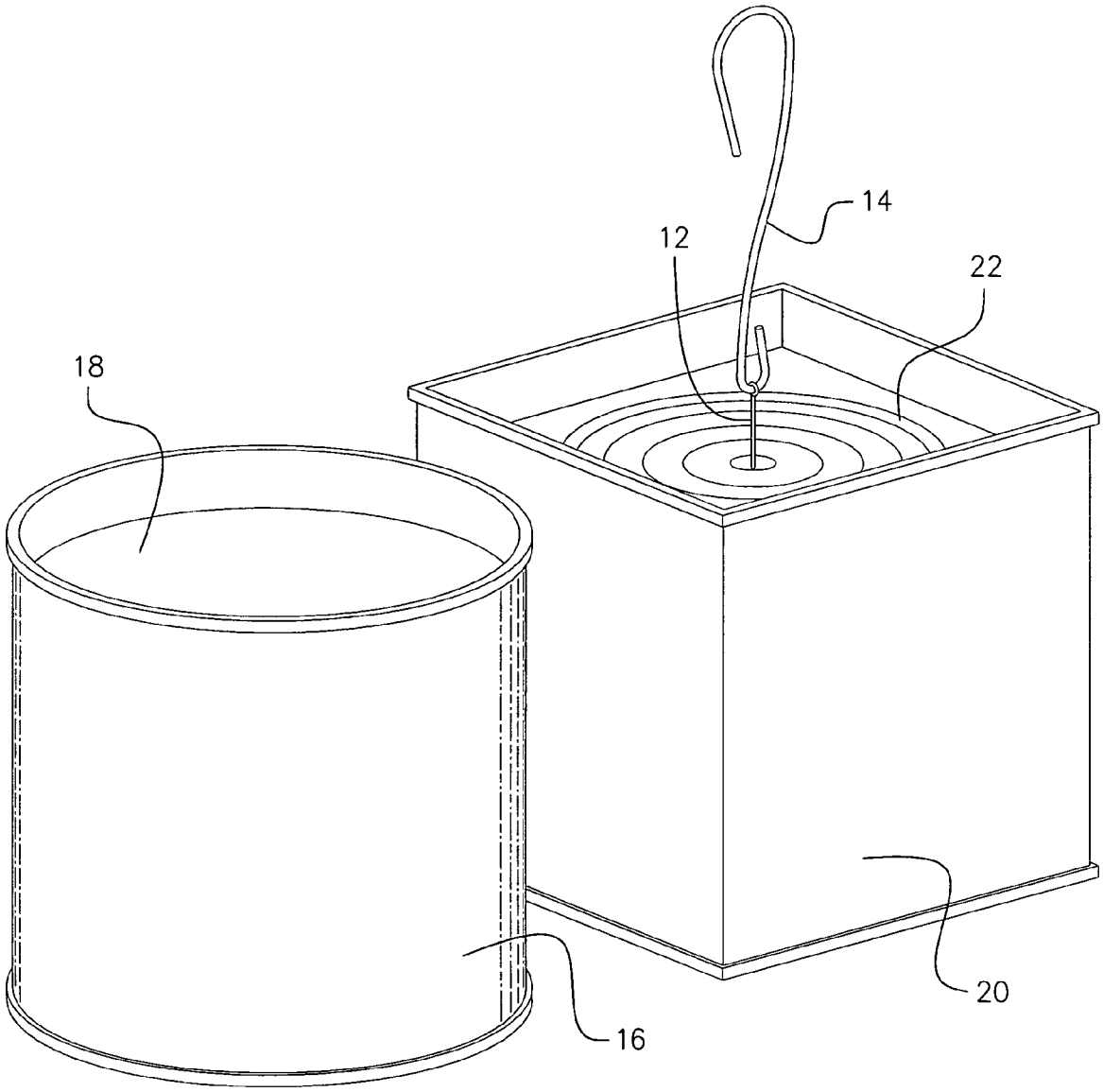
FIG. 11 shows candle being dipped into water.
Figure 12:
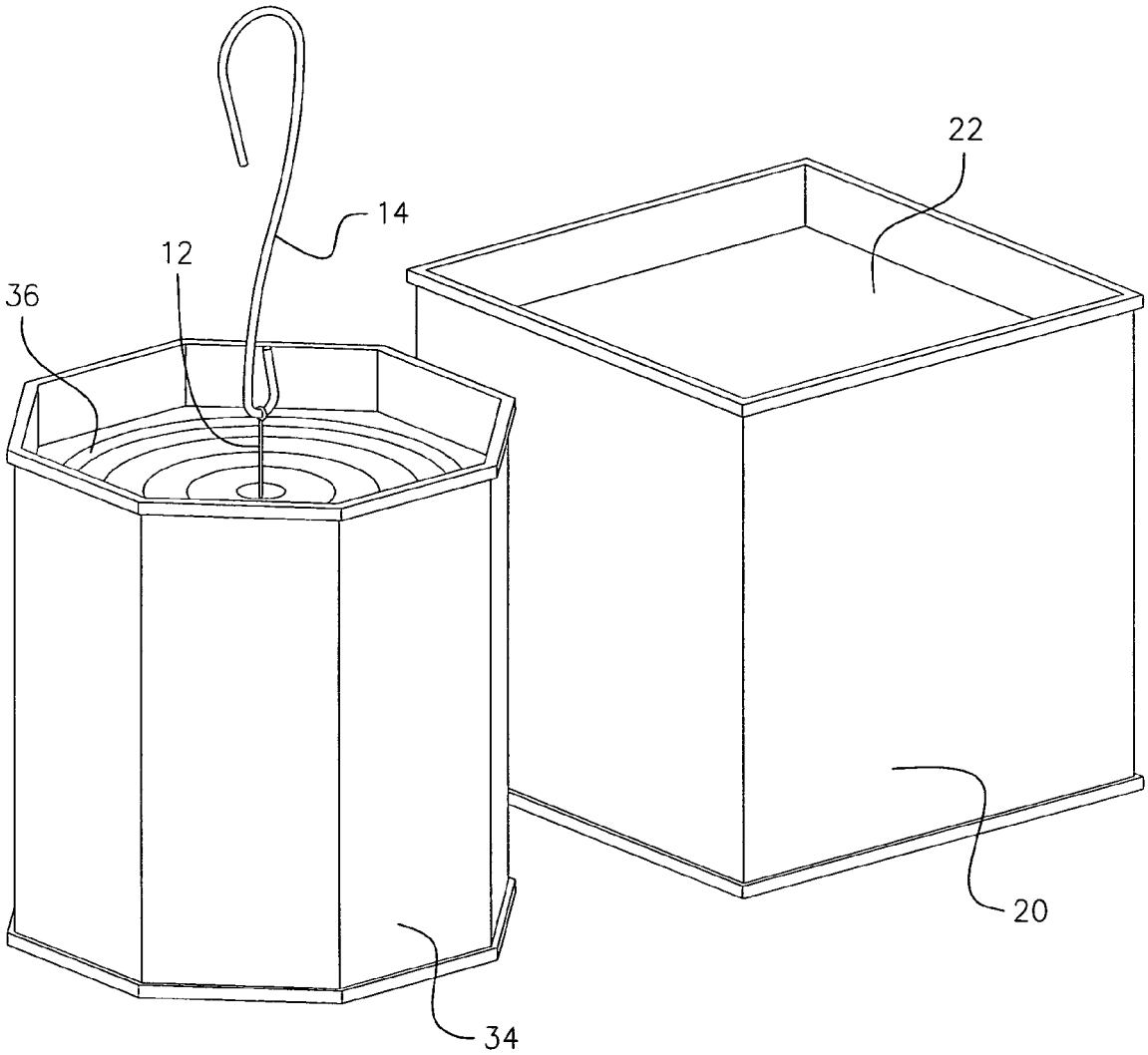
FIG. 12 shows candle dipped into liquid pigmented wax.
Figure 13:
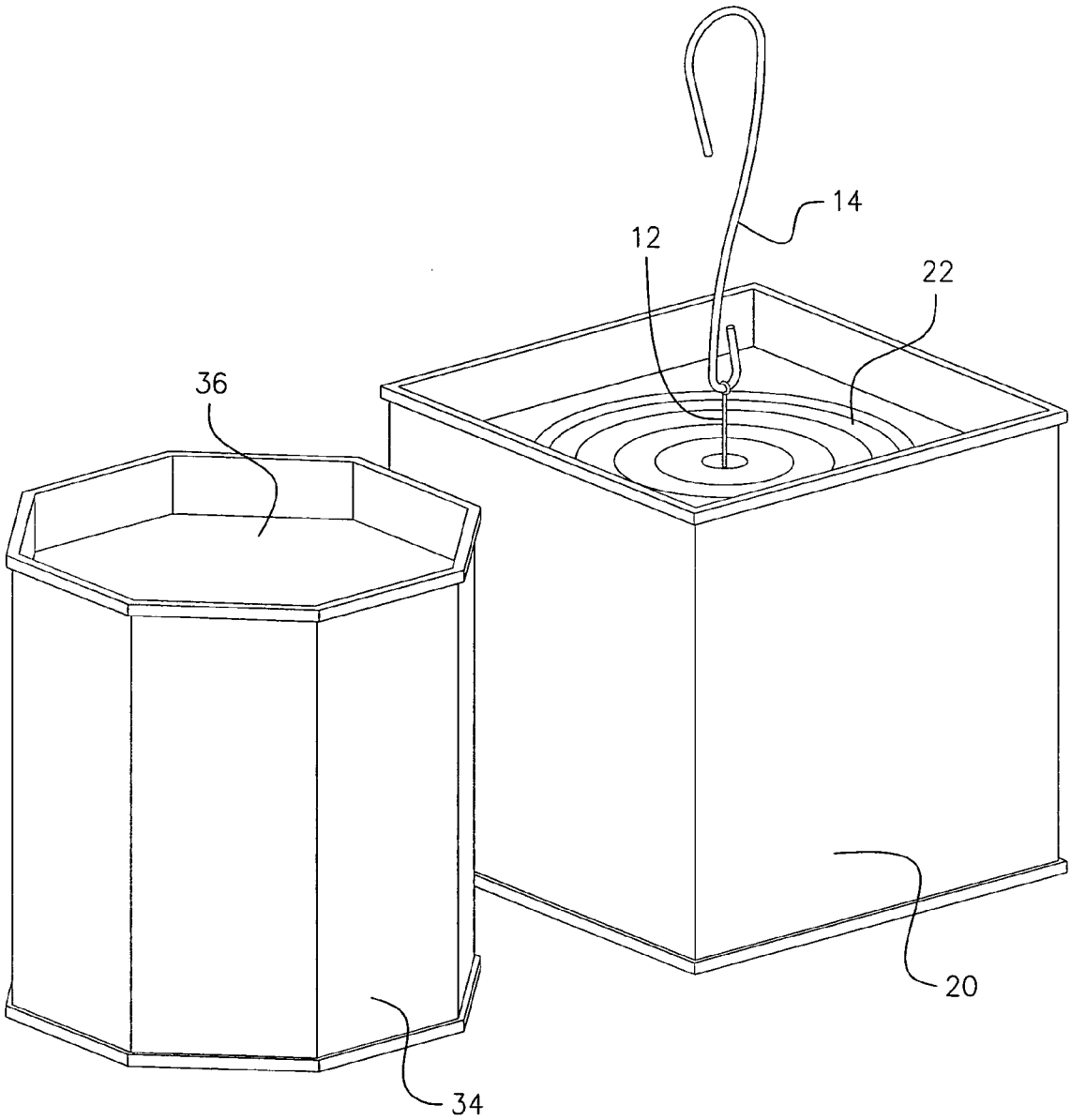
FIG. 13 shows candle dipped into water.
Figure 14:
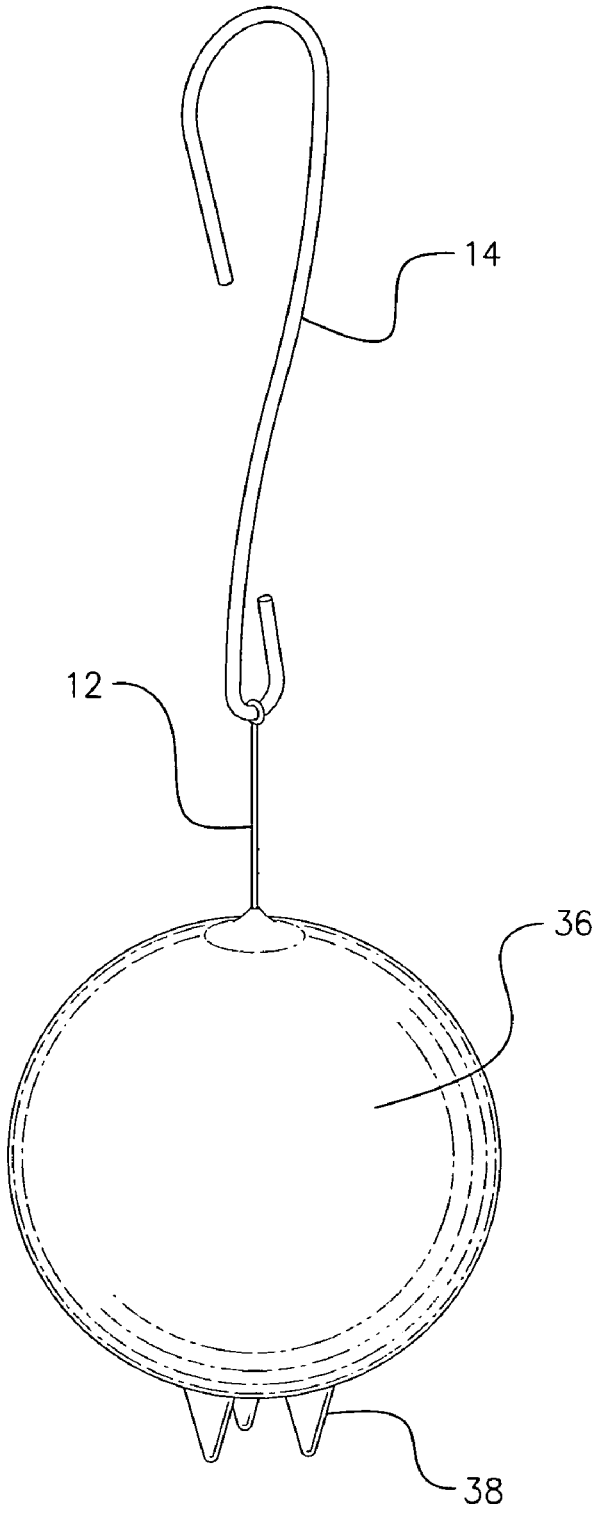
FIG. 14 shows candle after desired multiple layers have been applied.
Figure 15:
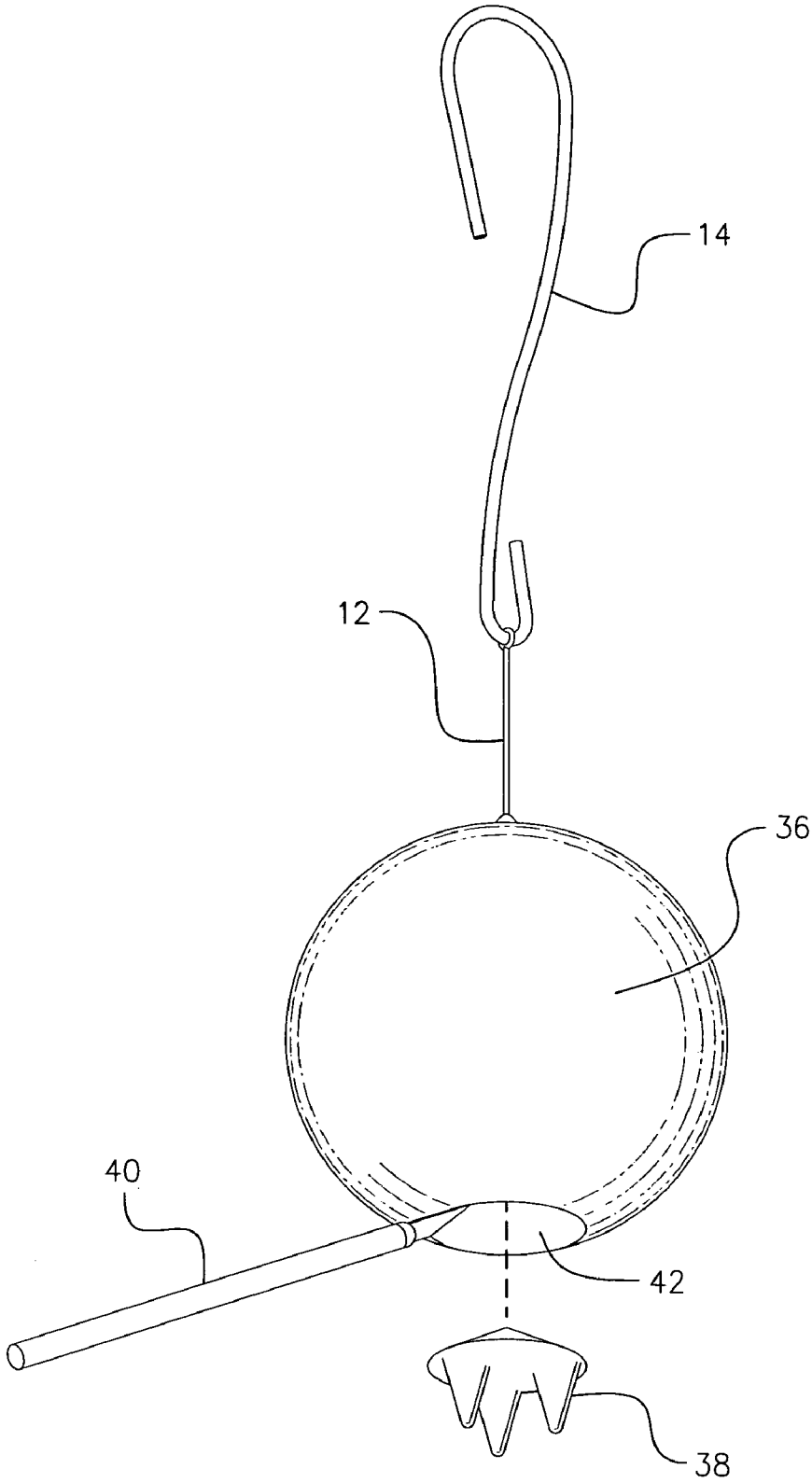
FIG. 15 shows candle bottom layer drippings being removed to create flat bottom.

The candle containing the primed layer 32 then goes through the process of multiple dippings in liquid clear wax 18 and water, usually two to ten times to create another layer prior to applying a second pigmented layer. See FIGS. 10–11. As seen in FIGS. 12–13 the candle is then dipped in a second pigmented wax tub 34 containing a second liquid pigmented wax 36 and sequentially a water tub 20. The dipping in tub 34 and tub 20 continues until a desired second color shade is achieved to create a second exterior color 36 as seen in FIG. 14. The bottom drippings 38 are cut off with a knife 40 to form a concave indentation 42 in the bottom of the candle.

Figure 16:
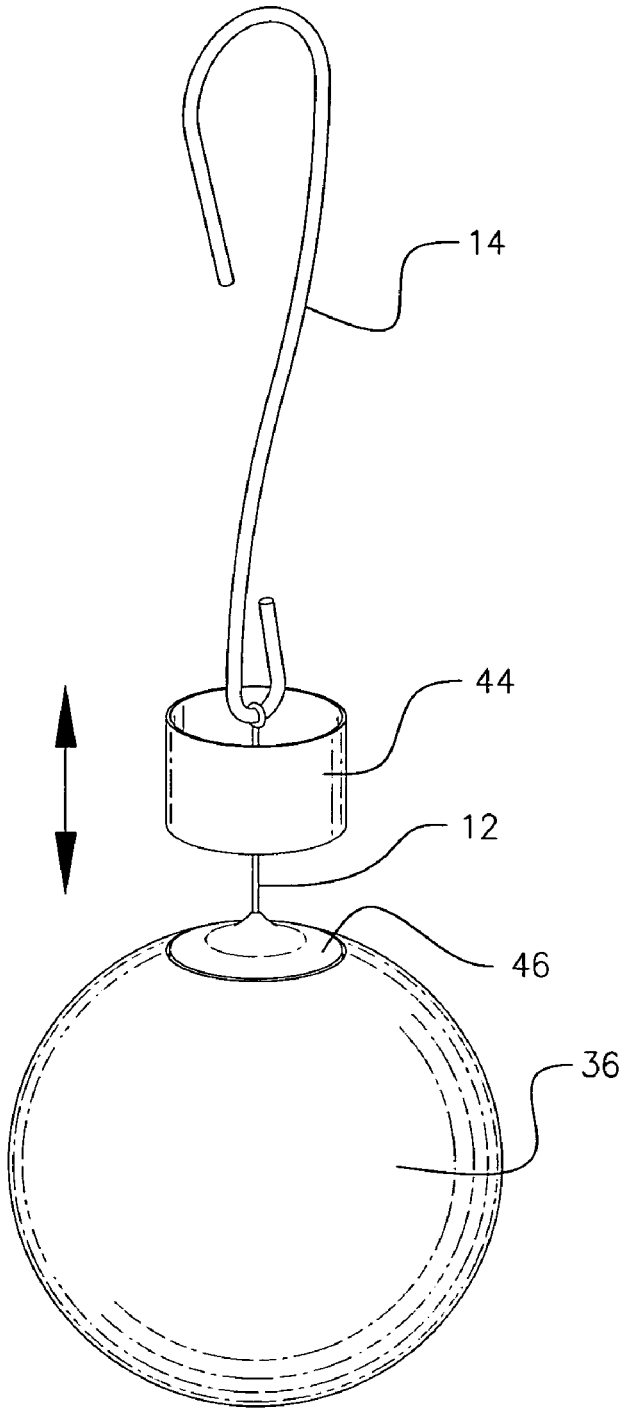
FIG. 16 shows top cutter being used to mark the non-cut area on top of the candle.

Additional layers 38 of color can be added by repeating the steps shown in FIGS. 10–14. An annular cutter 44 is used to mark a non-cut area 46 as seen in FIG. 16. The outer pigmented area 36 is then peeled away to form decorative designs 48. The first layer 28 of pigmented wax is now exposed as layer 36 is pulled away as shown in FIG. 17.

Figure 17:
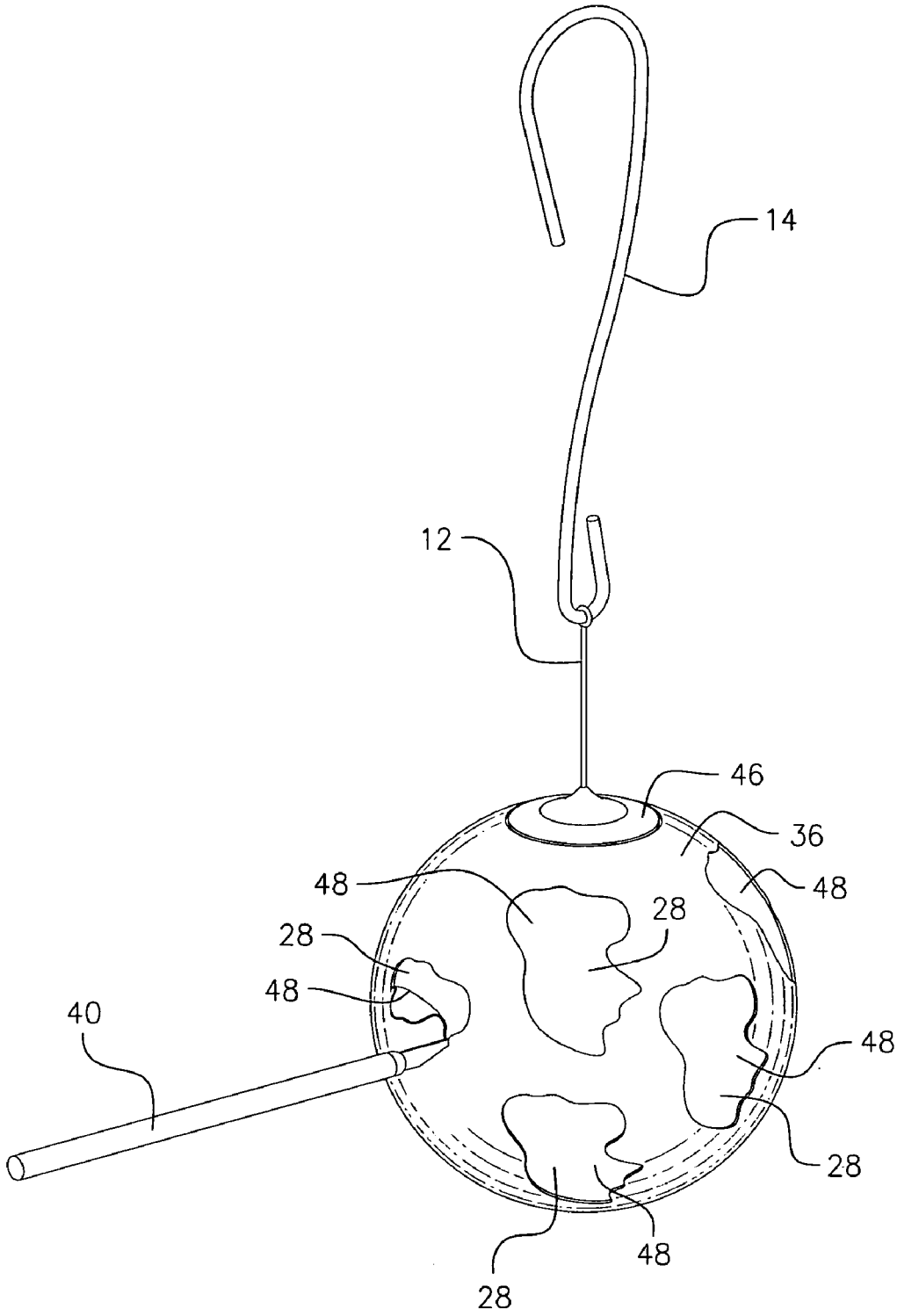
FIG. 17 shows a knife peeling off an outer wax layer to expose a different inner layer color.
Figure 18:
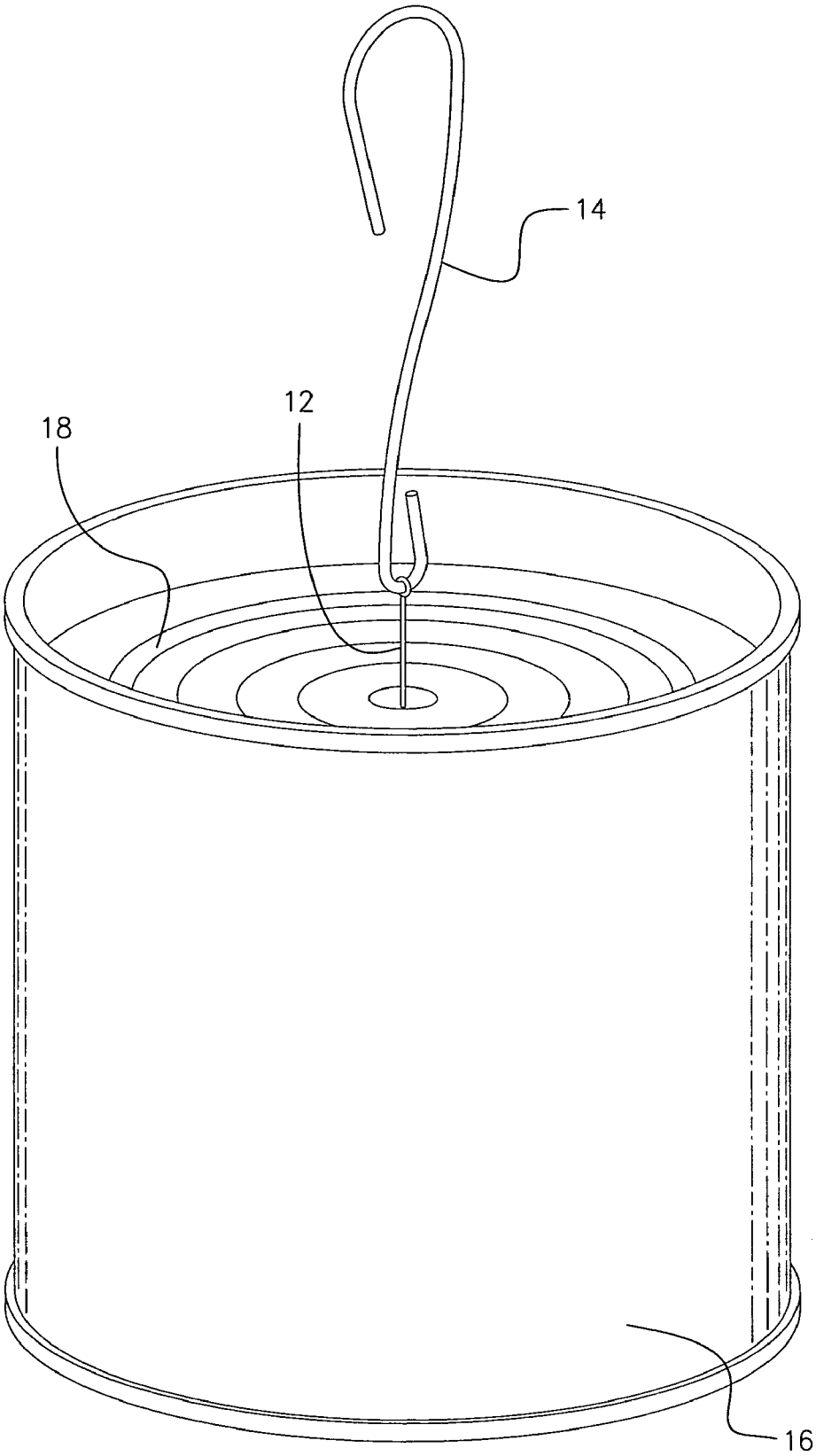
FIG. 18 shows candle dipped into a liquid clear wax.
Figure 19:
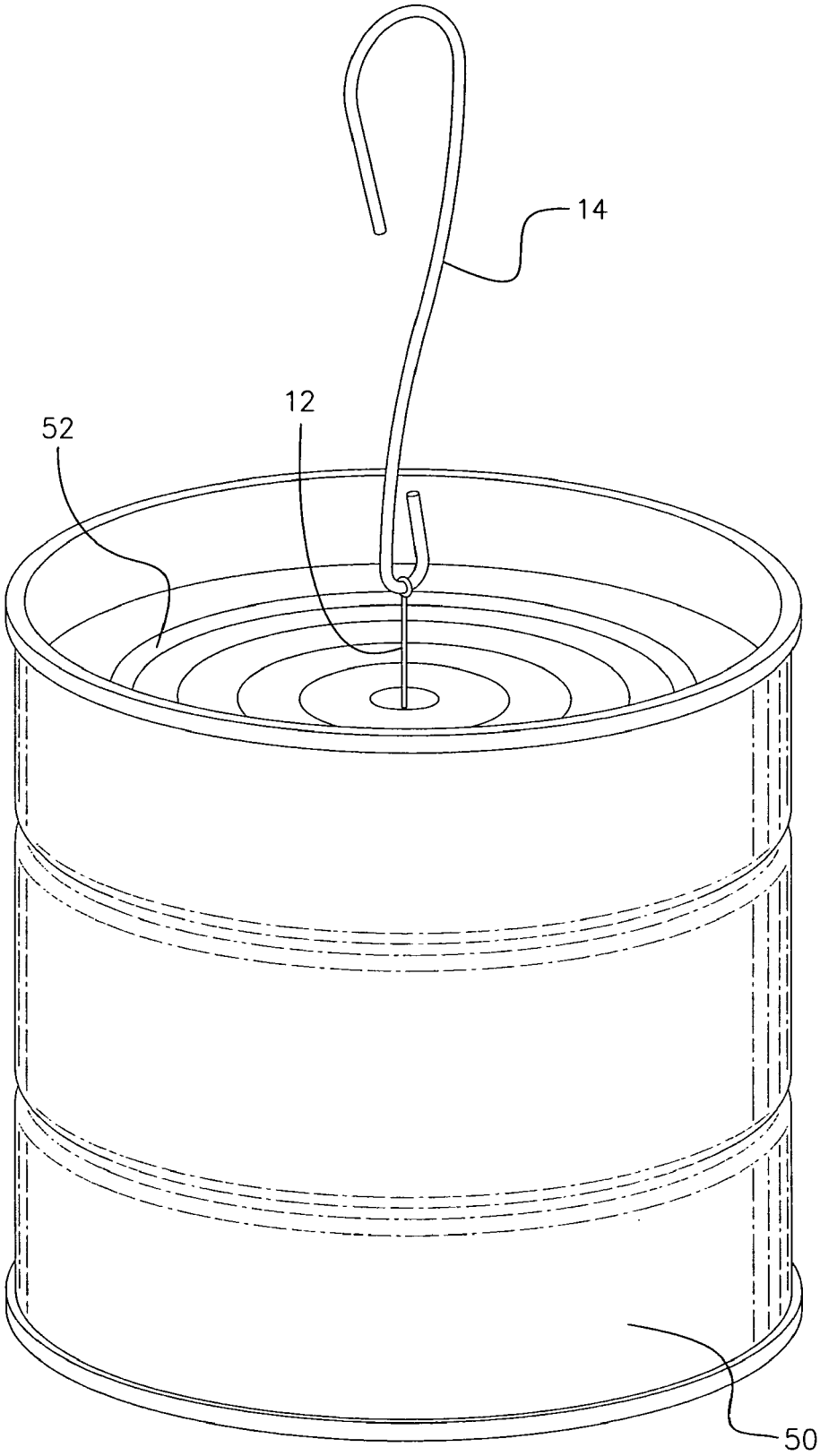
FIG. 19 shows candle dipped into a glaze.
Figure 20:
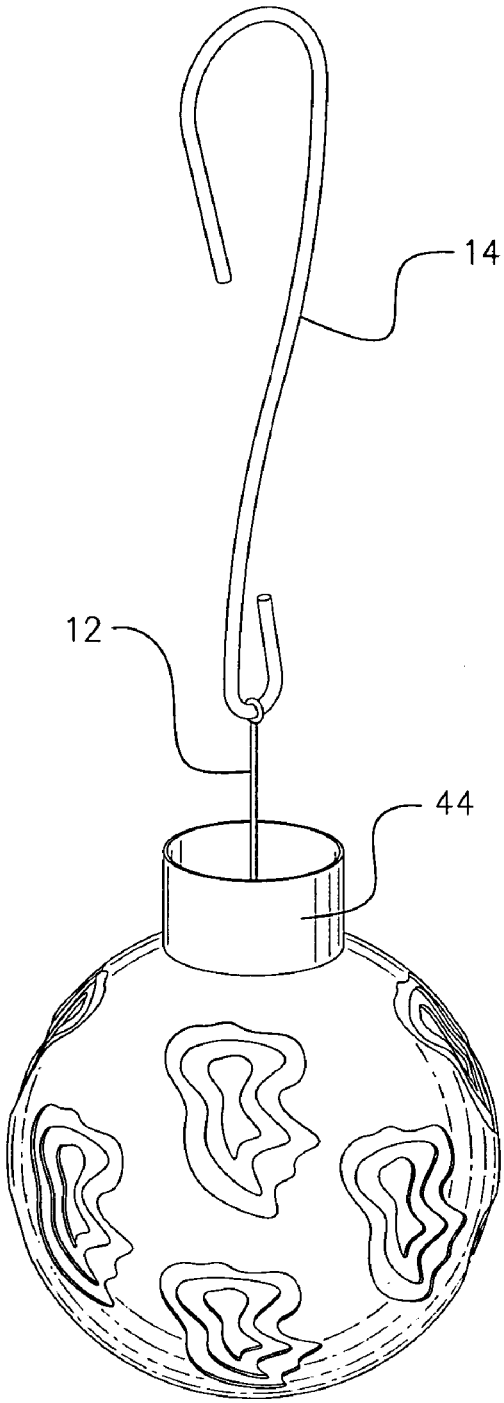
FIG. 20 shows a cutting away of a top portion of the candle.
Figure 21:
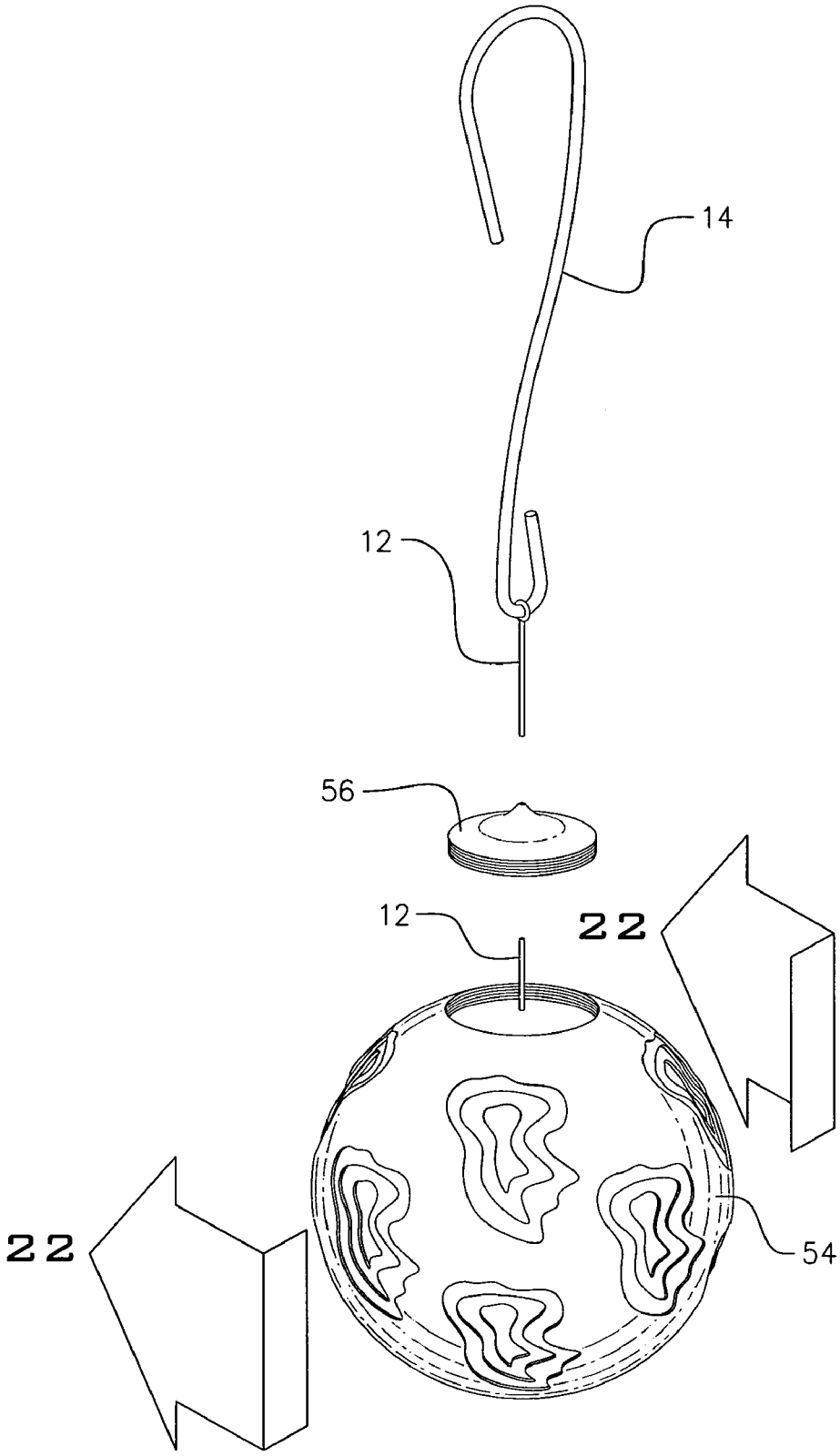
FIG. 21 shows the cut away portion of the candle and the completed multilayered colored candle of this invention.
Figure 22:
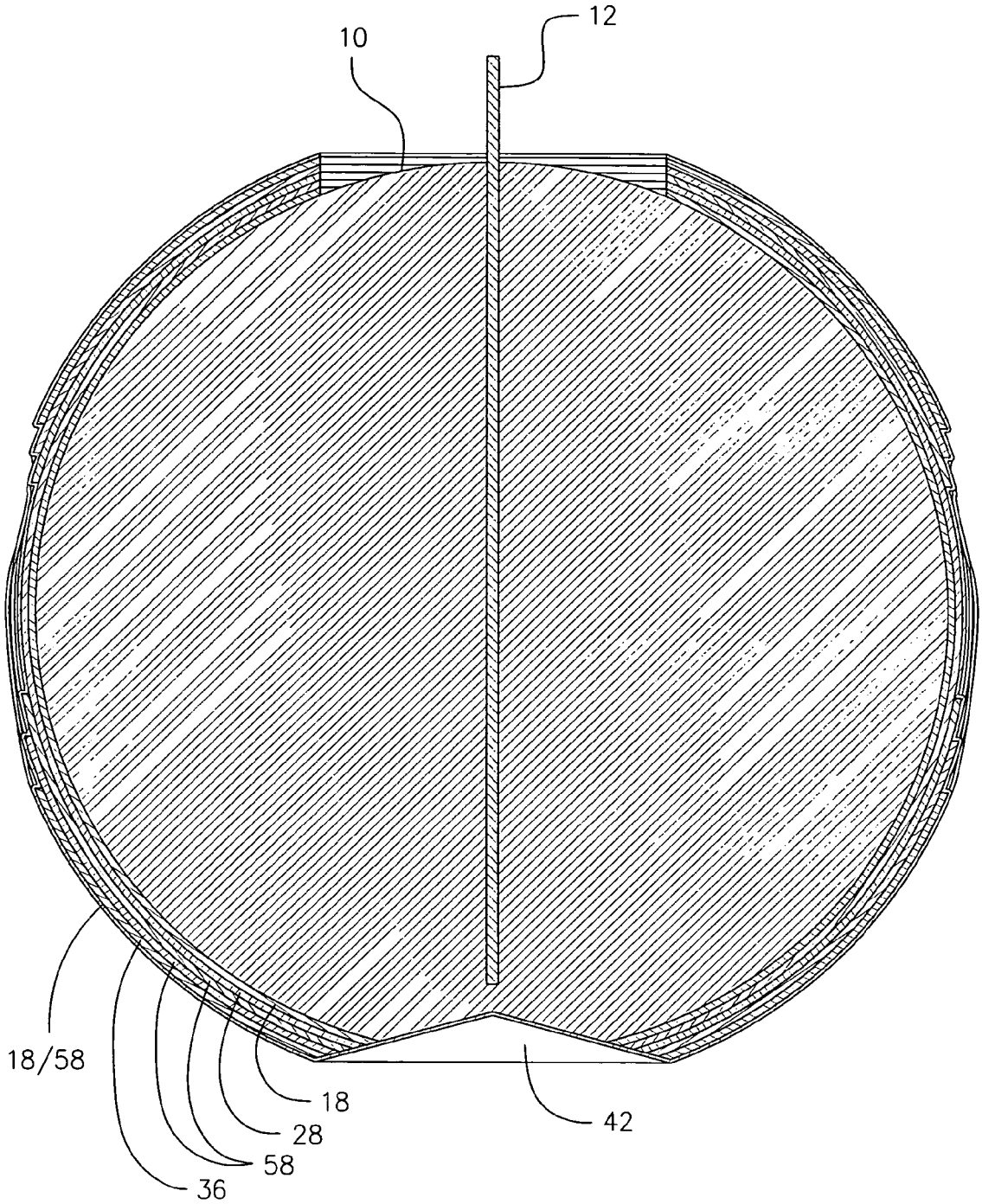
FIG. 22 is a sectional view of the multilayered colored candle along lines 22—22 in FIG. 21.

The candle of FIG. 17 is then dipped into a liquid clear wax 18 one to three times to form an outer clear wax layer. Subsequently, after the clear wax layer 18 has been added the candle is dipped into container 50 containing a liquid glaze 52. The preferred glaze is M-118 Candle Glaze II distributed by the Candlewic Company, Doylestown, Pa. When the glaze 52 has stopped dripping the top cutter cuts through all the layers as seen in FIG. 20. The final candle product 54 has the cut-away top 56 removed and the wick 12 cut as seen in FIG. 21.

Other equivalent steps can be substituted for the steps set forth above to producer substantially the same results in substantially the same way.

What is claimed is:

1. A process for producing a decorative candle having multiple pigmented layers, the process comprising:

(a) dipping a wax core containing a wick into a liquid clear wax multiple times in sequence with dipping the wax ball core in water;

(b) dipping the wax core coated by the process of step (a) into a first liquid pigmented wax multiple times in sequence with dipping in water to form a pigmented wax ball;

(c) dipping the pigmented wax ball in step (b) in a liquid clear wax and cooling the ball to about ambient temperature;

(d) rubbing an outer surface of the ball to form a primed layer;

(e) dipping the ball of step (d) multiple times in the liquid clear wax followed by dipping in water;

(f) dipping the ball of step (e) into a second liquid pigmented wax multiple times followed in sequence by dipping in water;

(g) dipping the pigmented wax ball containing the second pigmented wax in a liquid clear wax and cooling the ball to about ambient temperature to form a second primed layer;

(h) dipping the ball of step (g) multiple times in clear wax followed in sequence by dipping in water; and (i) decorating the ball of step (h) by peeling the second pigmented layer away in desired patterns.

2. The process for producing a decorative candle according to claim 1 wherein the candle is dipped in a glaze after step (i).

3. The process for producing a decorative candle according to claim 1 wherein the second primed layer becomes the intermediate layer by repeating the steps of (a) through (c).

4. The process for producing a decorative candle according to claim 1 wherein the liquid clear wax is provided in a container maintained at a temperature of about 125 to 195 degrees F.

5. The process for producing a decorative candle according to claim 1 wherein the liquid pigmented wax is provided in a container maintained at a temperature of about 125 to 195 degrees F.

6. The process for producing a decorative candle according to claim 1 wherein a dripping at the bottom of the candle is removed with a concave cut into the bottom of the candle.

7. The process for producing a decorative candle according to claim 2 wherein a top portion of the candle is removed after dipping in the glaze.

* * * * *